United States Patent [19]

Cornelius

[11] Patent Number: 4,703,564

[45] Date of Patent: Nov. 3, 1987

[54] APPARATUS FOR FORMING BRICK AND BLOCK PATTERNS ON STRUCTURAL SURFACES

[76] Inventor: George Cornelius, P.O. Box 469, Hesperia, Calif. 92345

[21] Appl. No.: 858,055

[22] Filed: Apr. 30, 1986

Related U.S. Application Data

[63] Continuation-in-part of Ser. No. 766,979, Aug. 19, 1985, abandoned.

[51] Int. Cl.[4] ..... E04G 21/20

[52] U.S. Cl. ..... 33/518; 33/404; 33/418; 33/41.6; 33/566; 15/235.3

[58] Field of Search ..... 33/518, 526, 565, 566, 33/41.1, 41.2, 41.6, 42, 43, 44, 403, 404, 407, 408, 418, 452, 474, 481, 484; 15/235.3, 235.4, 235.7; 427/271, 272

[56] References Cited

U.S. PATENT DOCUMENTS

| | | | |
|---|---|---|---|
| 831,104 | 9/1906 | Roberts | 33/404 |
| 833,675 | 10/1906 | Chezem | 15/235.3 |
| 1,383,301 | 7/1921 | Hendricks | 15/235.3 |
| 1,742,103 | 12/1929 | Sholtes | 33/404 |
| 2,162,861 | 6/1939 | Polak | 15/235.3 |
| 2,534,940 | 12/1950 | Arnold | 33/404 |
| 2,548,350 | 4/1951 | Combs | 33/469 |
| 2,602,232 | 7/1952 | Keast | 15/235.3 |
| 2,625,747 | 1/1953 | Acker | 33/518 |
| 4,060,902 | 12/1977 | Keller | 33/403 |
| 4,497,114 | 2/1985 | Belcher | 33/410 |

*Primary Examiner*—Charles Frankfort
*Assistant Examiner*—Patrick R. Scanlon
*Attorney, Agent, or Firm*—Edward A. Sokolski

[57] ABSTRACT

An under layer of a mortar material such as stucco is first applied to a structural surface such as a wall or floor. Over this under layer a second layer is applied generally of a different color than the first layer. A tool having a guide bar, an elongated strip forming a measuring rod removably attached along one edge of the guide bar, a bubble level mounted thereon and a handle for manipulating the guide bar is used to form a straight edge for a mortar scratcher which is used to groove channels in the top layer of material. The measuring rod is placed in successive channels thus formed to provide a guide for the formation of subsequent such channels. The measuring rod is removably attached to the guide bar and can be selectively positioned in a vertical orientation relative thereto or in predetermined angular orientations so that the guide bar can be utilized in forming channels at right angles or acute angles relative to the channels initially formed.

7 Claims, 13 Drawing Figures

APPARATUS FOR FORMING BRICK AND BLOCK PATTERNS ON STRUCTURAL SURFACES

This application is a continuation-in-part of my application Ser. No. 766,979 filed Aug. 19, 1985 and now abandoned.

The simulation of brick and block patterns in stucco and other cementitious and plastic material has been well known in the art for many years. Techniques and instruments for achieving this end result are described in U.S. Pat. Nos. 2,625,747 to Acker, 2,162,861 to Polak, 2,602,232 to Keast, 4,060,902 to Keller, and 4,497,114 to Belcher. These prior art patents describe various techniques and apparatus inclulding various mortar grooving or routing tools or templates for use in forming the desired patterns. The device and method of the present invention is an improvement over that shown in the prior art in that it provides a simple and economical tool and technique which can be used in a versatile manner for accurately forming a variety of brick and block patterns without the need for templates.

The improvement is achieved in the present invention by employing a tool which includes a guide bar to which a measuring rod is removably attached in one of several different predetermined positions. The measuring rod is designed to fit into the grooved out channel portions of cement to form an accurate reference for an edge of the guide bar which provides a guide for a mortar scratching tool which is used to form successive channels in the cementitious material. Thus, successive horizontal channels can be rapidly and accurately formed in a mortar layer on a wall with the measuring rod attached to the guide bar in a horizontal position. After the horizontal channels have been formed, the measuring rod can be positioned normal to the longitudinal axis of the guide bar to facilitate the alignment of the guide bar in a vertical orientation to enable the grooving out of the vertical channels of the design. This device can similarly be used in forming patterns on floor and ceiling structures. Further, the measuring rod can be positioned at an acute angle relative to the longitudinal axis of the guide bar to enable the formation of angulated patterns.

It is therefore an object of this invention to provide a simple and economical method and tool for forming brick and block patterns in cementitious material and the like.

It is a further object of this invention to facilitate the formation of brick and block patterns in cementitious material and the like.

Other objects of the invention will become apparent as the description proceeds in connnection with the accompanying drawings of which:

Figure 3:
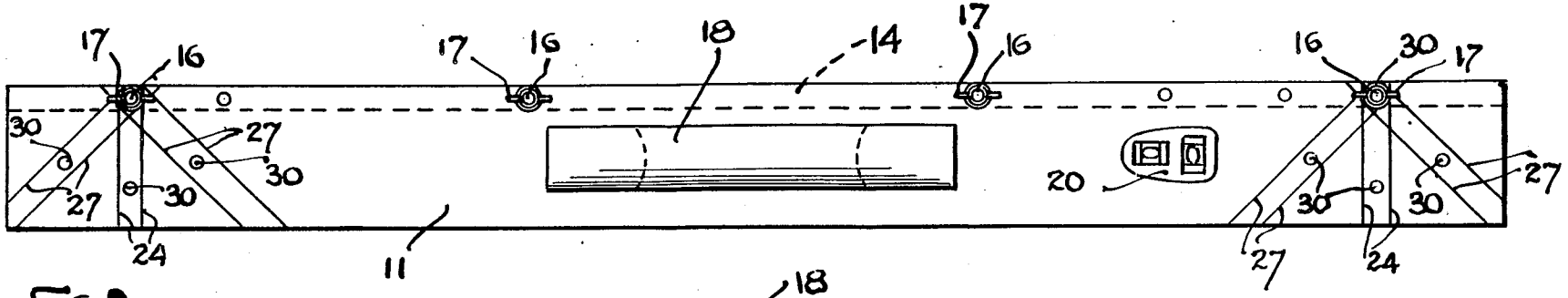
FIG. 3 is a top plan view of a first embodiment of the invention.
Figure 4:
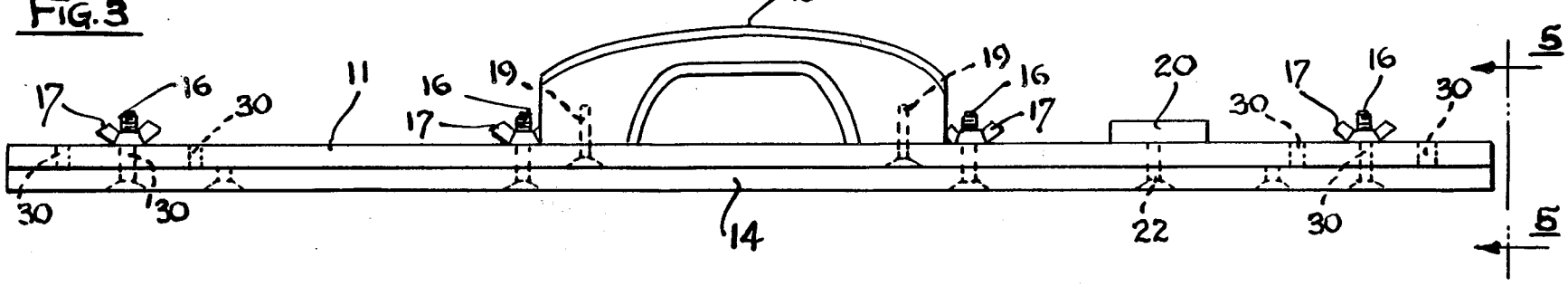
FIG. 4 is a side elevational view of the first embodiment.
Figure 5:
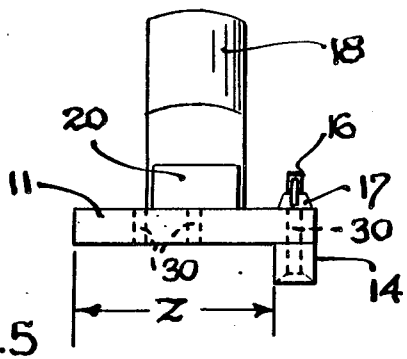
FIG. 5 is a view taken along the plane indicated by 5—5 in FIG. 4.

Referring now to FIGS. 3-5, a first embodiment of the invention is illustrated. Guide bar 11 is an elongated flat member which may be fabricated of plastic and has a thickness which typically is about ½ inch. The length of guide bar 11 is typically of the order of 32 inches. Measuring rod 14 is removably attached to guide bar 11 along one edge thereof by means of screws 16 and wing nuts 17. Measuring rod 14 typically has a width of ½ inch so that it can comfortably fit into channels having a width of ⅝ inches. The height of measuring rod 14 is typicallly ½ inch to fit in channels having approximately this same depth. The total width of guide bar 11 is typically three inches for making brick patterns having a 2½ inch width, this corresponding to dimension "Z" shown in FIG. 5. A handle 18 is attached to guide bar 11 by means of screws 19. Further, a bubble level 20 is attached to the guide bar by means of screw 22. The guide bar has transverse lines 24 and acute angulated lines 27 scored therein. Apertures 30 are formed in the guide bar within these lines for use, as later to be explained, in repositioning measuring rod 14 along either one or the other of the sets of lines 24 or 30 in reorienting the direction of the guide bar for making channels running in various different directions.

Figure 6:
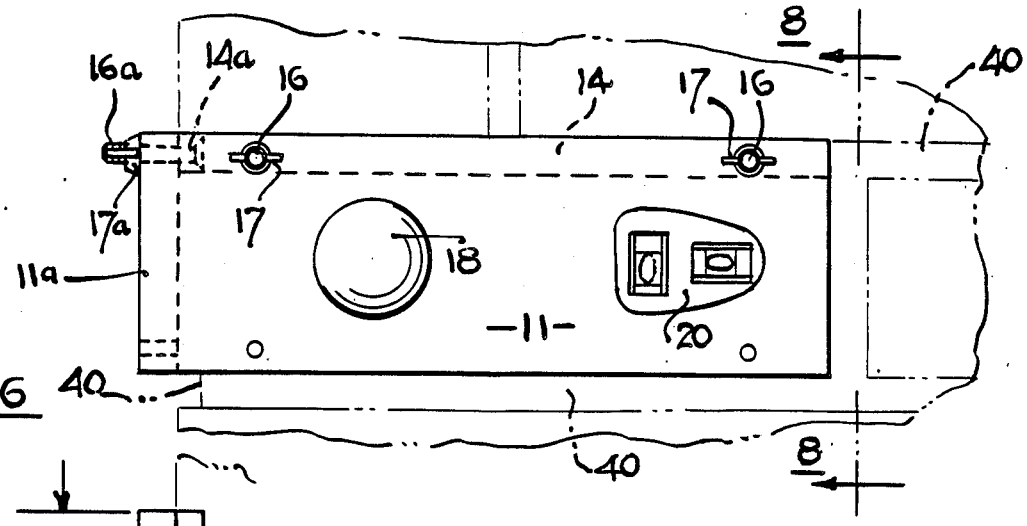
FIG. 6 is a top plan view of a second embodiment of the invention.
Figure 7:
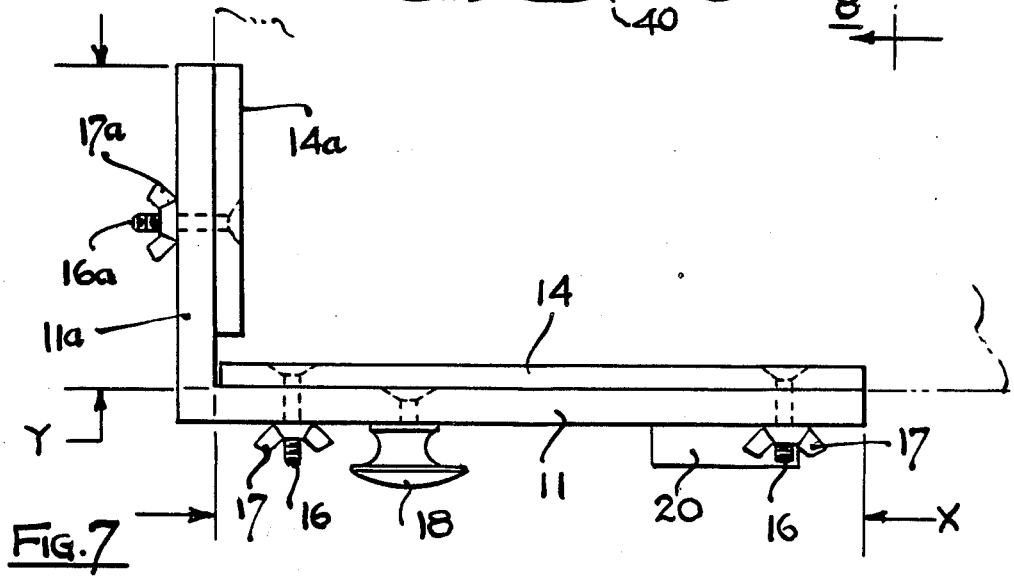
FIG. 7 is a top plan view of the second embodiment.
Figure 8:
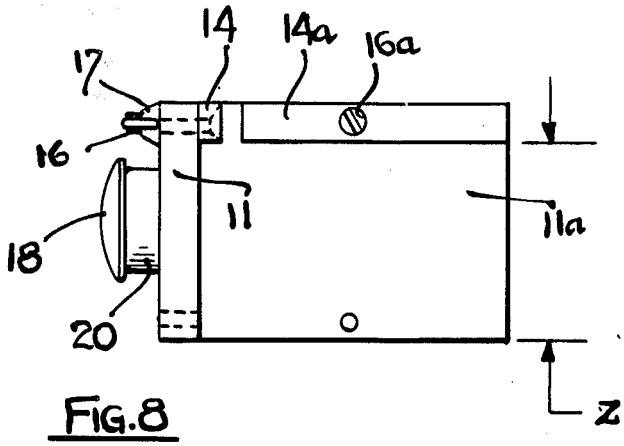
FIG. 8 is a view taken along the plane indicated by 8—8 in FIG. 6.

Referring now to FIGS. 6-8, a second embodiment of the invention is illustrated. This embodiment is suitable for use in forming brick patterns at corners. As for the previous embodiment the device includes a guide bar 11 and a measuring rod 14 which is removably attached to the guide bar along an edge thereof by means of screws 16 and wing nuts 17. Also, as for the previous embodiment, a handle 18 and a bubble level 20 are mounted on the guide bar. The device further includes an additional guide bar section **11*a* fixedly attached to guide bar 11 at right angles thereto as for example by cementing. Removably attached to guide bar 11*a* along the top edge thereof is measuring rod section 14*a* such attachment being made by means of a screw 16*a* and wing nut 17*a*. The guide bar sections 11 and 11*a* and measuring rod sections 14 and 14*a* are dimensioned similarly to the measuring rod and guide bar of the previous embodiment except for the fact that the length of guide bar 11 (indicated by "X" in FIG. 7) is equal to that of a brick in the brick pattern to be formed and the length "Y" of guide bar 11a** as indicated in FIG. 7 is equal to ½ the length of a brick in a pattern to be formed.

Figure 9:
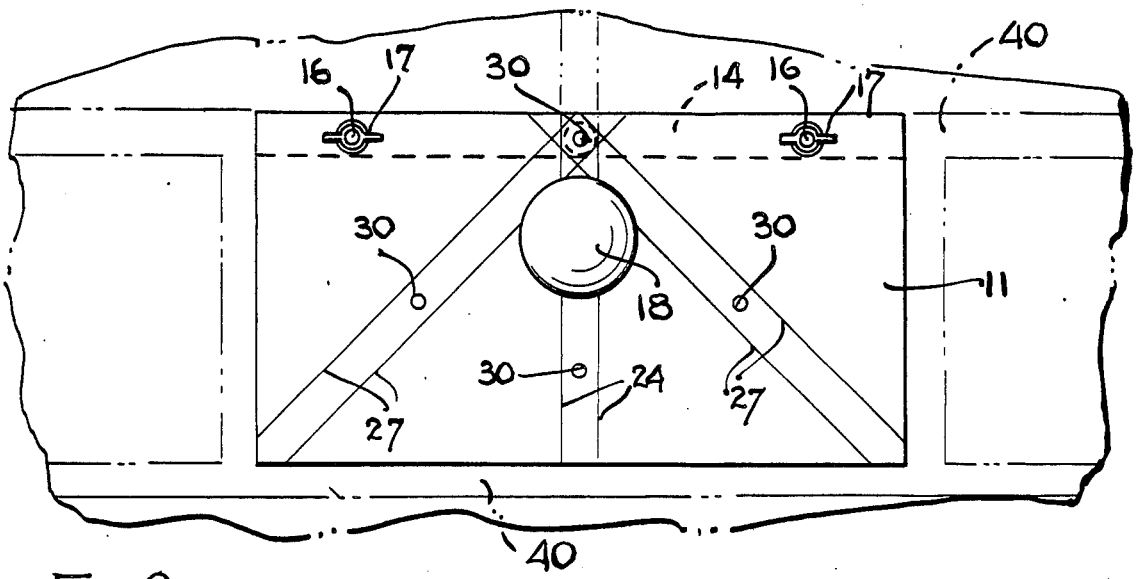
FIG. 9 is a top plan view of a third embodiment of the invention.
Figure 10:
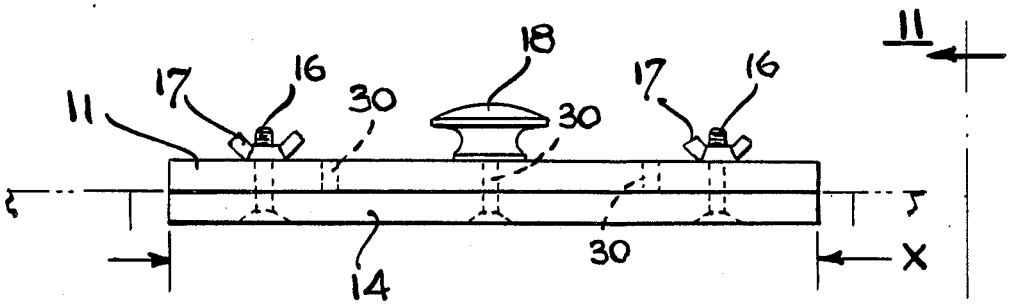
FIG. 10 is a side elevational view of the third embodiment.
Figure 11:
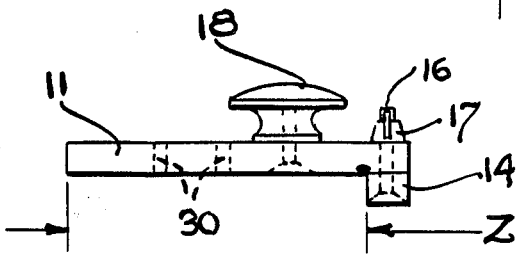
FIG. 11 is a view taken along the plane indicated by 11—11 in FIG. 10.

Referring now to FIGS. 9-11, a further embodiment of the invention is illustrated. This embodiment is suitable for forming single bricks of a brick pattern. In this embodiment, guide bar 11 has a length "X" (See FIG. 10) which is equal to that of a brick in the brick pattern to be formed. The measuring rod 14 as for the previous embodiments is removably attached to the guide bar along one edge thereof by means of screws 16 and wing nuts 17. A handle 18 is attached to the guide bar. As for the first embodiment, pairs of angulated lines 27 are scribed in the guide bar as well as lines 24 which run at right angles (i.e. transversely) to the top edge of the guide bar, these lines defining alternative positions for attaching the measuring rod to the guide bar by means of screws 16 and nuts 17 in conjunction with apertures 30 formed in the guide bar. As for the previous embodiment the dimensions "X" and "Z" shown in the figures represent the length and width of the bricks in the brick pattern to be formed, the width of the measuring rod 14 being slightly under the width of the channels formed in the brick pattern and its height being equal to the depth of these channels.

Figure 1A:
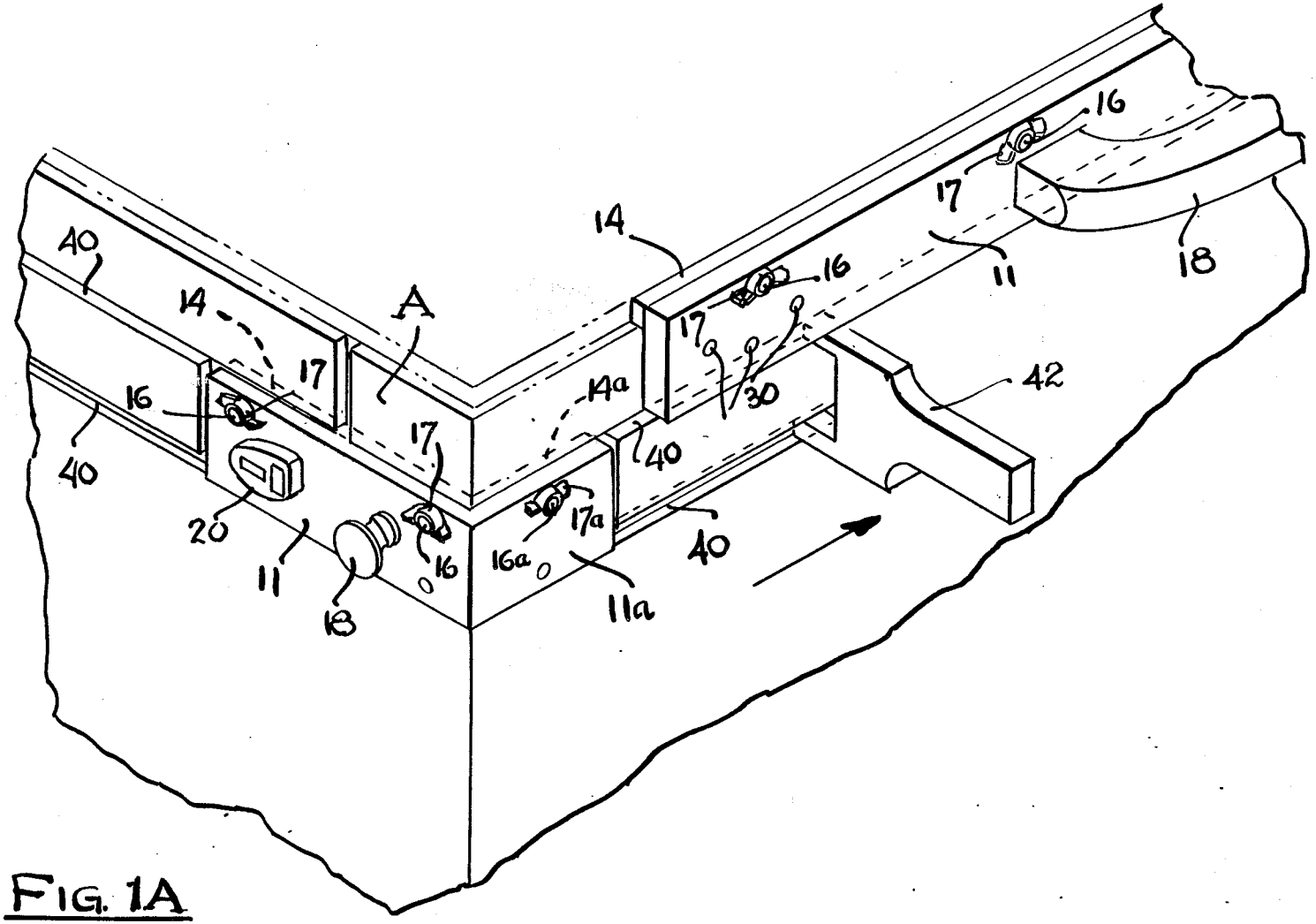
FIG. 1A is a perspective view illustrating the use of embodiments of the invention in the formation of horizontal channels in a wall structure.

Referring now to FIG. 1A, the use of the first embodiment of the invention in forming horizontal channels in a wall is illustrated. The device is first aligned along the top edge of the wall with measuring rod 14 resting along this top edge as shown in the figure. With the guide bar so set a pair of horizontal channels 40 are formed in the mortar with mortar scratching tool 42 as shown in the figure. In the event that there is no top edge on which to rest the measuring rod then the measuring rod is aligned by means of the bubble level 20 (See FIG 3) in forming the initial channels. Subsequent channels are formed by inserting the measuring rod 14 into the last channel formed and thus aligning the guide bar for forming succeeding horizontal channels.

Figure 1B:
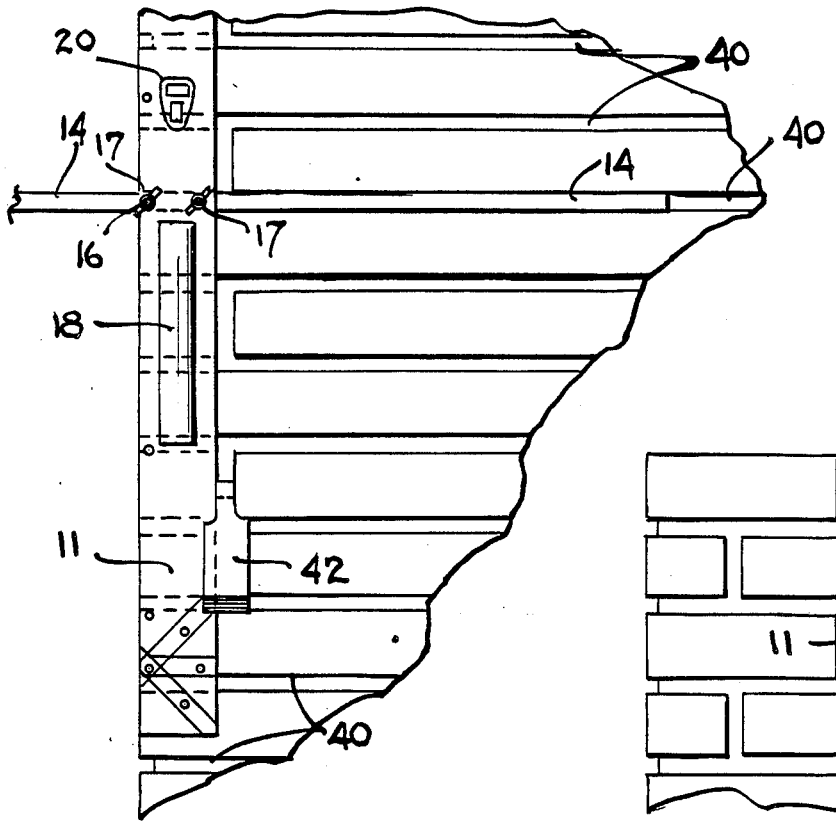
FIG. 1B is a side elevational view illustrating the use of an embodiment of the invention in forming vertical channels in a wall structure.

Referring now to FIG. 1B, after all of the horizontal channels have been formed, the measuring rod is removed from its horizontal mounting on guide bar 11 and oriented vertically and fastened to the guide bar by means of screws 16 and wing nuts 17 which are inserted through apertures 30 as shown in FIG. 1B. The measuring rod is installed in one of the channels 40 and guide bar 11 oriented to form vertical channels with mortar scratcher 42 in every other mortar strip as shown in the figure. After these vertical channels have been formed at distances apart representing the length of a brick, the guide bar is oriented half way between the brick patterns thus formed and vertical channels formed in the mortar strips in which such channels had not been previously formed, these channels being half-way between those on adjacent strips to form an offset pattern.

The brick pattern at corners is formed by means of the tool of FIGS. 6–8 as shown in FIG. 1A with a single element mortar scratcher. The measuring rods 14 and **14*a* are inserted in the horizontal channels 40** already formed, the corner unit being utilized to form the vertical channels. This corner unit is turned over 180° to form the pattern as shown at "A".

Figure 2B:
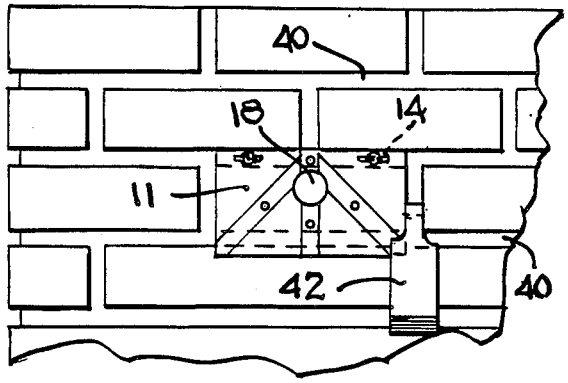
FIG. 2B is a side elevational view illustrating the utilization of an embodiment of the invention in making vertical channels in a wall structure.
Figure 2A:
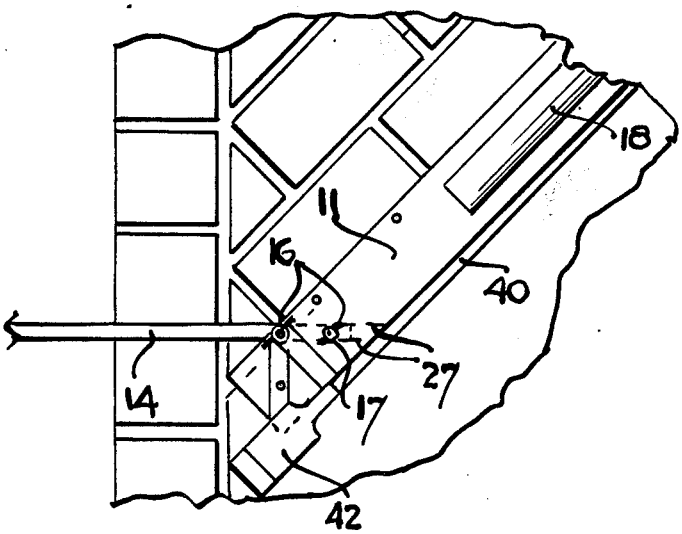
FIG. 2A is a view illustrating the use of an embodiment of the invention in forming angulated patterns in a floor or wall structure.

Referring now to FIG. 2A, the use of the embodiment of 9–11 in forming angled patterns on a floor is illustrated. As can be seen, measuring rod 14 is aligned between scribe lines 27 and retained in position by screws 16 and wing nut 17 which pass through apertures 30. The measuring rod then is placed in a groove 40 previously formed and an angulated channel 40 formed by means of mortar scratcher 42 which is drawn along the edge of the guide bar as shown in the figure.

Referring now to FIG. 2B, the use of the embodiment of FIGS. 9–11 in forming both vertical and horizontal channels is illustrated. In this instance, the unit is placed in a channel 40 already formed, and with a single mortar scratcher 42 both vertical and horizontal channel portions are formed along the edges of the unit, the unit being successively positioned to form succeeding brick patterns.

The device of the invention thus can be utilized to form many different brick patterns without the need for templates or other such aids.

While the invention has been described and illustrated in detail, it is to be clearly understood that this is intended by way of illustration and example only and is not to be taken by way of limitation, the spirit and scope of the invention being limited only by the terms of the following claims.

I claim:

1. A device for use in grooving channels to form brick or block patterns in material applied to a structural surface comprising:

a guide bar having at least one flat surface and a straight edge along one side of said surface, a measuring rod in the form of an elongated strip, means for selectively removably attaching said measuring rod to said guide bar in a first position along an edge thereof opposite and parallel to the straight edge thereof and a second position at a preselected angle relative to the straight edge thereof, said measuring rod being adapted to be placed in a previously formed channel of the brick or block pattern thereby orienting said guide bar for forming an additional channel, and tool means for grooving said additional channel, said tool means being drawn along said straight edge to form said channel, said additional channel being parallel to said previously formed channel when said measuring rod is attached to the guide bar in said first position and at said preselected angle relative to said previously formed channel when said measuring rod is attached to the guide bar in said second position.

2. The device of claim 1 wherein said measuring rod is attached to said guide bar along an edge thereof opposite to and parallel to said straight edge thereof.

3. The device of claim 1 wherein said means for removably attaching said measuring rod to said guide bar comprises a first pair of opposing lines scored in said bar and running normal to said straight edge, a second pair of opposing lines scored in said guide bar and running at an acute relative to said edge, spaced apertures being formed in said guide bar between said first pair of lines and between said second pair of lines, said measuring rod having apertures formed therein spaced by a distance equal to that between the aperture formed in the guide bar and screw and nut means passing through said apertures for removably connecting the measuring rod to a selected position along said guide bar between a pair of said opposing lines.

4. The device of claim 1 and further including handle means attached to said guide bar for manipulating said guide bar.

5. The device of claim 1 and further including a bubble level mounted on said guide bar.

6. The device of claim 1 wherein said guide bar and said measuring rod each have first and second sections at right angles to each other.

7. The device of claim 1 wherein the guide bar has a length equal to that of a brick in the brick pattern to be formed, the width of the measuring rod being slightly less than that of the channels and the height thereof being substantially equal to the depth of said channels, the width of the guide bar less the width of the measuring rod being equal to the width of the bricks in said brick pattern.

* * * * *